United States Patent [19]

McKinzie et al.

[11] 4,136,895

[45] Jan. 30, 1979

[54] INDEXED MANIFOLD SET

[75] Inventors: Richard E. McKinzie; Joseph J. Juszak, both of Crystal Lake, Ill.

[73] Assignee: Uarco Incorporated, Barrington, Ill.

[21] Appl. No.: 851,183

[22] Filed: Nov. 14, 1977

[51] Int. Cl.[2] ..... B41L 1/20; B41L 1/24

[52] U.S. Cl. ..... 282/9 R; 282/22 R; 282/23 R

[58] Field of Search ..... 282/22 R, 23 R, 9 R, 282/8 R; 283/11

[56] References Cited

U.S. PATENT DOCUMENTS

| | | | |
|---|---|---|---|
| 1,222,010 | 4/1917 | Mack | 283/11 |
| 2,362,952 | 11/1944 | Watkins | 282/22 R X |
| 3,131,951 | 5/1964 | Ohlsson | 282/22 R |

*Primary Examiner*—Travis S. McGehee

*Attorney, Agent, or Firm*—Wegner, Stellman, McCord, Wiles & Wood

[57] ABSTRACT

A manifold set including index tabs to facilitate filing and indexing of the components thereof, including a plurality of superimposed sheets of paper and glue lines securing the sheets together adjacent a corresponding edge of each sheet. Image transfer material is disposed at the interface of adjacent sheets for transferring the image placed on the uppermost sheet to corresponding locations on the lower sheets and lines of weakening are located in each sheet inwardly of the edge and of the glue. Each line of weakening has a linear part and a bulbous part and extends across the set. The linear parts of each line of weakening are aligned across the set and the bulbous parts of each line of weakening are staggered across the set so that when the lines are broken, a plurality of individual sheets having individual, staggered index tabs, are provided.

6 Claims, 3 Drawing Figures

INDEXED MANIFOLD SET

BACKGROUND OF THE INVENTION

This invention relates to manifold sets and, more particularly, to an improved manifold set wherein indexing and filing of the sheets of the set is facilitated.

There are a great many differing uses of manifold sets in existence today and a number of such uses require that the individual sheets of the set, after separation from the stub, be separately indexed for ease of future reference. For example, manifold sets may be used as patient care chart forms in hospitals. Various reports are prepared by medical personnel relating to the care of a particular patient and an indexing system of some type is desirable so that physicians, nurses, etc., can easily refer to a particular report from time to time.

All of such reports must be identified with the patient's name and other pertinent information and, typically, an imprinting plate system is commonly used for this purpose. In the usual case, the various reports will be imprinted with patient identification, one sheet at a time, and placed in the patient's chart holder. Indexing is conventionally achieved by taking separate index dividers and inserting them into the chart holder with the reports or by affixing separate indexing tabs to corresponding reports.

The individual placement of patient identification information on each sheet is time-consuming as is the placement of index dividers in a chart holder and/or the placement of index tabs on individual sheets.

SUMMARY OF THE INVENTION

It is the principle object of the invention to provide a new and improved manifold set. More specifically, it is an object of the invention to provide such a manifold set wherein provision is made for image transfer of information required on all sheets of the set to eliminate individual application of such information to each sheet and to provide indexing means on the sheets of the set to avoid the need for index dividers and/or the affixing of index tabs to the sheets after they have been separated from the set.

An exemplary embodiment of the invention achieves the foregoing object in a manifold set including a plurality of superimposed sheets of paper. Means secure the sheets of paper together adjacent a corresponding edge of each sheet and image transfer means are located at the interface of adjacent sheets for transferring the image placed on the uppermost sheet to corresponding locations on lower sheets. Lines of weakening are placed in each sheet inwardly of the edge and of the securing means and each line of weakening extends across the associated sheet and has first and second, nonaligned parts and at least one third part angularly disposed with respect to the first and second parts and interconnecting the same. At least some of the third parts are staggered with respect to each other so that when the lines of weakening are broken, a plurality of individual sheets having individual index tabs are provided with the index tabs being staggered to facilitate filing.

In a preferred embodiment, the lines of weakening each have a linear part and a bulbous part, the bulbous part defining the index tabs. Preferably, the bulbous part extends from the linear part toward the edge of the sheets.

In one embodiment, the image transfer means comprise carbon sheets which are secured into the set by the securing means which, in turn, may comprise glue lines. Consequently, on separation of the sheets along the lines of weakening, the carbon sheets will be removed from the set.

Other objects and advantages will become apparent from the following specification taken in connection with the accompanying drawings.

DESCRIPTION OF THE PREFERRED EMBODIMENT

Figure 1:
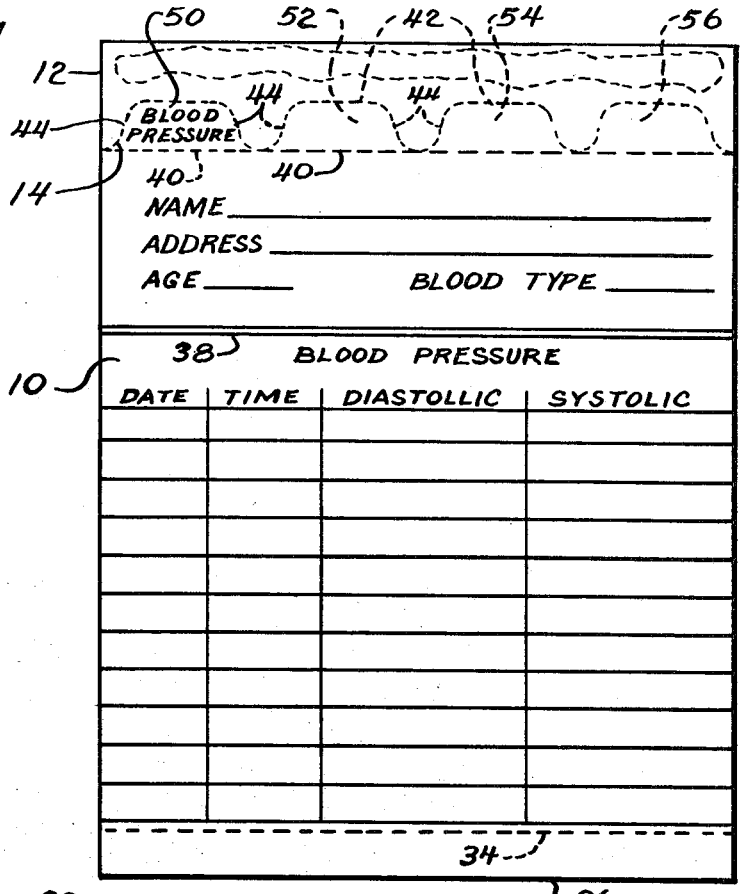
FIG. 1 is a plan view of a manifold set made according to the invention.
Figure 2:
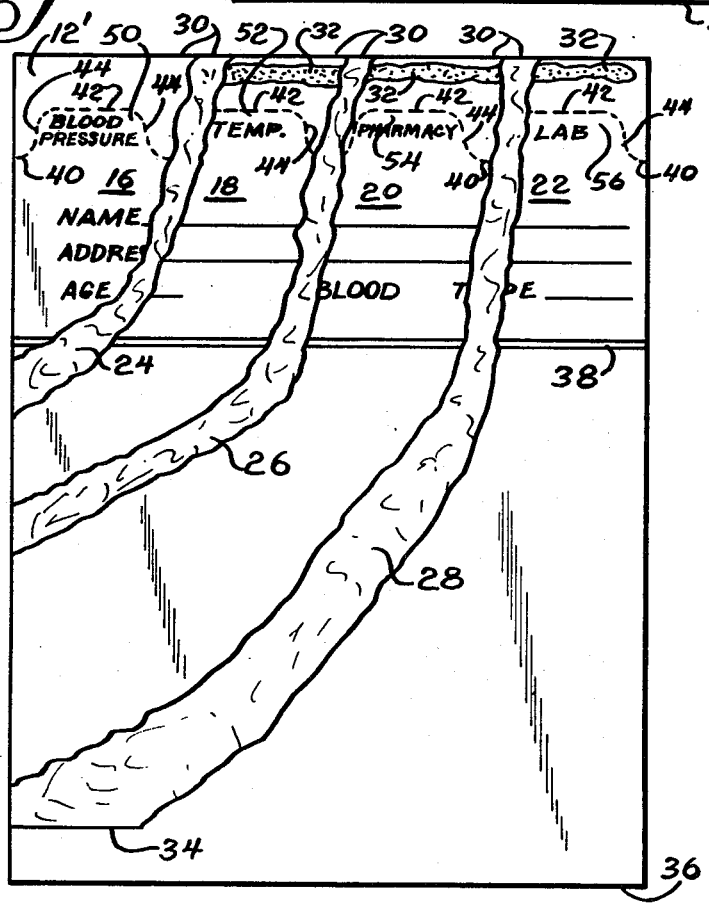
FIG. 2 is a plan view of the manifold set with parts of various sheets in the set removed.
Figure 3:
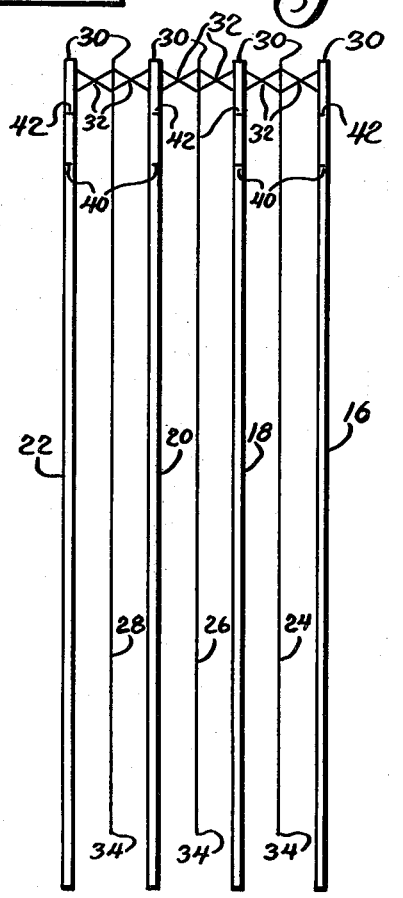
FIG. 3 is a schematic, side view of the set.

An exemplary embodiment of a manifold set made according to the invention is illustrated in the drawings, and with reference to FIG. 1, is seen to include an information bearing part 10 and a stub 12 separated from the information bearing part 10 by lines of weakening 14. As seen in FIGS. 2 and 3, the manifold set is defined by a plurality of superimposed sheets of paper 16, 18, 20 and 22 for a total of four in all, although, as will be apparent to those skilled in the art, greater or lesser numbers of sheets may be utilized.

Image transfer means in the form of carbon sheets 24, 26 and 28 are disposed between adjacent ones of the sheets 16–22 for transferring images placed on the uppermost sheet 16 to the lower sheets 18, 20 and 22. The paper sheets 16–22 and the carbon sheets 24–28 are aligned at corresponding edges 30 and glue lines 32, shown schematically in FIG. 3, secure the paper sheets 16–22 and the carbon sheets 24–28 together.

The carbon sheets 24–28 may be full length sheets, that is, of substantially the same length as the paper sheets 16–22, as illustrated in FIGS. 2 and 3. As is conventional, the lower edges 34 of the carbon sheets will terminate just short of the lower edges 36 of the paper sheets 16–22 so as to facilitate separation of the manifold set. With this construction, one need only grasp the stub 12 and the paper sheets 16–22 adjacent their lower edges 36 without gripping the carbon paper sheets 24–28 at their lower edge 34 and exert a pulling force. The stub 12 will separate from the remainder of the set along the lines of weakening 14 and the carbon paper sheets 24–28 will remain secured to the stub by the glue lines 32 so that they need not be individually removed.

Such a construction will be typically used where all information applied to the uppermost sheet 16 is also to be applied to one or more of the lowermost sheets. However, where only certain of the information applied to the uppermost paper sheet 16 is to be applied to lower sheets, the length of the carbon sheets 24, 26 and 28 may be altered appropriately. For example, in hospital usage of the type mentioned previously, wherein each of the sheets 16–22 is to bear identical patient identification information, but the remainder of the information on each sheet will vary depending upon conditions being monitored, as, for example, blood pressure, temperature, pharmacy use and laboratory results, as indicated by the captions shown in FIG. 2, the carbon sheets 24, 26 and 28 need only extend to the end of the area which is to bear common information. In the precise type of form illustrated, if such were done, the carbon sheets would extend only to the double line 38 shown in FIGS. 1 and 2 delineating the end of the common information part of the set.

The lines of weakening 14 are disposed in each of the paper sheets 16–22 inwardly of the aligned edges 30 of the various sheets and of the glue lines 32. Each line of weakening 14 is composed of three parts. A first part 40 is formed as a straight line and, in the exemplary embodiment, extends generally parallel to the edge 30 of the corresponding sheet. A second part 42 is displaced from the first part 40 in the direction of the glue lines 32 and also may be parallel to the edge 30 of the corresponding sheet. Each line 14 further includes at least one third part 44 which is angularly related to both the first and second parts 40 and 42 and interconnects the same such that the lines of weakening 14 are continuous and extend completely across the form. In the disclosed embodiment, each line of weakening 14 has two of the third parts 44 interconnecting segments of the first part 40, as seen in FIGS. 1 and 2.

The first parts 40 of the lines of weakening 14 in each of the sheets 16–22 are in alignment and, in the preferred embodiment, the second parts 42 are similarly in alignment. However, at least one of the third parts 44 of each line of weakening 14, and preferably, though not necessarily, both third parts 44 of each line of weakening 14, are staggered with respect to the third parts on other sheets across the width of the form. As a consequence, an index tab is defined by the second and third parts 42 and 44 of each line of weakening, the index tab of the first sheet 16 being designated 50, the index tab of the second sheet 18 being designated 52, the index tab of the third sheet 20 being designated 54, and the index tab of the fourth sheet 22 being designated 56. As can be seen from FIGS. 1 and 2, the index tabs 50–56 are staggered seriatim left to right across the top of the set.

In a hospital setting of the type mentioned previously, the form may be used as follows. Patient identification information may be imprinted upon the sheet 16 in a suitable fashion and will be transferred to the lower sheets 18, 20 and 22 by the carbon sheets 24–28. The set may then be separated into individual sheets in the manner mentioned previously by removing the stub 12. The individual sheets resulting from the separation operation will all contain the patient's identification information which was placed thereon in a single operation as opposed to four, as would be required according to prior practice, and each will already have an appropriate index tab 50–56, staggered to facilitate filing, upon separation. Thus, any need for the use of index dividers and/or the application of separate index tabs is avoided.

If desired, the carbon sheets 24–28 may be omitted in favor of so-called "hot spots" transfer material placed on the undersides of the sheets 16, 18 and 20. Alternately, the interfaces of the sheets where image transfer is desired may be sensitized with chemicals which will interreact to form an image upon the application of an image to the uppermost sheet 16.

The index tabs 50–56 will always extend toward the glue lines but may be on the top of the set with respect to printing orientation (as shown), the side or the bottom. Where the sheets are to be held by a clipboard, the tabs generally will be on the bottom of the sheet.

Those parts of the lines of weakening forming the tabs 50–56 may be completely slit or may include small, easily rupturable ties, as desired.

It should also be recognized that the form is not restricted to use of the type mentioned wherein each of the sheets receives, in part, differing information. For example, all information on each of the sheets could be common in which case the index tabs 50–56 serve as a ready guide for routing a particular copy to a particular location and/or may serve as a guide for manual retrieval of a particular copy after filing.

From the foregoing, it will be appreciated that a manifold set made according to the invention eliminates the need for separately inscribing common information on a plurality of forms, each of which is to bear, in part, other information not common to each of the forms. It will also be recognized that a manifold set made according to the invention eliminates the need for index dividers in filing systems and/or the need to apply indexing tabs to individual sheets to achieve indexing. Consequently, use of the forms eliminates considerable handling time to facilitate efficiency of clerical personnel.

We claim:

1. A manifold set comprising:

a plurality of superimposed sheets of paper;

means securing said sheets of paper together adjacent a corresponding edge of each sheet;

image transfer means at the interface of adjacent sheets for transferring an image placed on the uppermost sheet to corresponding locations on the lower sheets; and lines of weakening in each sheet inwardly of said edge and of said securing means, each said line of weakening having a linear part and a bulbous part and extending across said set, the linear parts of each line of weakening being aligned across the set and the bulbous parts of each line of weakening being staggered across the set whereby when said lines are broken, a plurality of individual sheets having individual index tabs are provided with the index tabs being staggered.

2. The manifold set of claim 1 wherein said bulbous parts extend from said linear parts toward said edge.

3. The manifold set of claim 1 wherein said image transfer means comprise carbon sheets and said securing means secures said carbon sheets within the set.

4. A manifold set comprising:

a plurality of superimposed sheets of paper;

means securing said sheets of paper together adjacent a corresponding edge of each sheet;

image transfer means at the interface of adjacent sheets for transferring an image placed on the uppermost sheet to locations at the lower sheets; and lines of weakening in each sheet inwardly of said edge and of said securing means, each said line of weakening extending across the associated sheet and having first and second nonaligned parts and at least one third part angularly disposed with respect to said first and second parts and interconnecting the same, at least some of said third parts being staggered with respect to each other.

5. A manifold set comprising:

a plurality of superimposed sheets of paper;

image transfer sheets disposed between adjacent paper sheets for transferring images placed on the uppermost paper sheet to at least selected areas on the lower sheets;

said sheets having at least one edge aligned with corresponding edges on the other sheets;

glue lines on said sheets adjacent said edge securing said sheets together; and a line of weakening in each of said paper sheets inwardly of said glue lines from said edge to define a stub, said lines of weakening generally being straight along their length but having tab forming deviations extending toward said glue lines, said lines of weakening being generally aligned but with the deviations being staggered from paper sheet to paper sheet.

6. A manifold set comprising:

a plurality of superimposed sheets of paper;

image transfer sheets disposed between adjacent paper sheets for transferring images placed on the uppermost paper sheet to at least selected areas on the lower sheet;

said sheets having at least one edge aligned with corresponding edges on the other sheets;

glue lines on said sheets adjacent said edge securing said sheets together; and a line of weakening in each of said paper sheets inwardly of said glue lines from said edge to define a stub, said lines of weakening generally being straight along their length but having tab forming deviations extending toward said glue lines, the generally straight parts of said lines of weakening being aligned.

* * * * *